United States Patent [19]

Nishimoto

[11] Patent Number: 4,467,690

[45] Date of Patent: Aug. 28, 1984

[54] AUTOMATIC RHYTHM PERFORMANCE DEVICE

[75] Inventor: Tetsuo Nishimoto, Hamamatsu, Japan

[73] Assignee: Nippon Gakki Seizo Kabushiki Kaisha, Hamamatsu, Japan

[21] Appl. No.: 504,504

[22] Filed: Jun. 15, 1983

[30] Foreign Application Priority Data

Jun. 25, 1982 [JP] Japan ..... 57-108327

[51] Int. Cl.[3] ..... G10H 1/42; G10H 1/46

[52] U.S. Cl. ..... 84/1.03; 84/1.27; 84/DIG. 12

[58] Field of Search ..... 84/1.03, 1.27, DIG. 12

[56] References Cited

U.S. PATENT DOCUMENTS 4,336,736 6/1982 Mishima ..... 84/1.03 X

*Primary Examiner*—S. J. Witkowski

*Attorney, Agent, or Firm*—Spensley Horn Jubas & Lubitz

[57] ABSTRACT

An automatic rhythm performance device is constructed of a rhythm pattern memory, an instrument memory and a rhythm tone generator. The rhythm pattern memory delivers a variety of rhythm patterns corresponding to the selected rhythm. The instrument memory delivers instrument names of instruments to be performed corresponding to the selected rhythm too. The rhythm tone generator generates percussive instrument tones of the delivered instrument names at the timing designated by the corresponding rhythm patterns, respectively. In the above rhythm performance device, the selectable rhythms are grouped into some groups in advance. This grouping enables the instrument memory to be constructed of two stage memories. One stores group numbers identifying such groups, and the other stores the instrument names in every such group. The delivery of the instrument names is performed by addressing by the outputted group number to which the selected rhythm belongs. This double stage memory construction need less storage areas about storing the instrument names to be performed.

7 Claims, 10 Drawing Figures

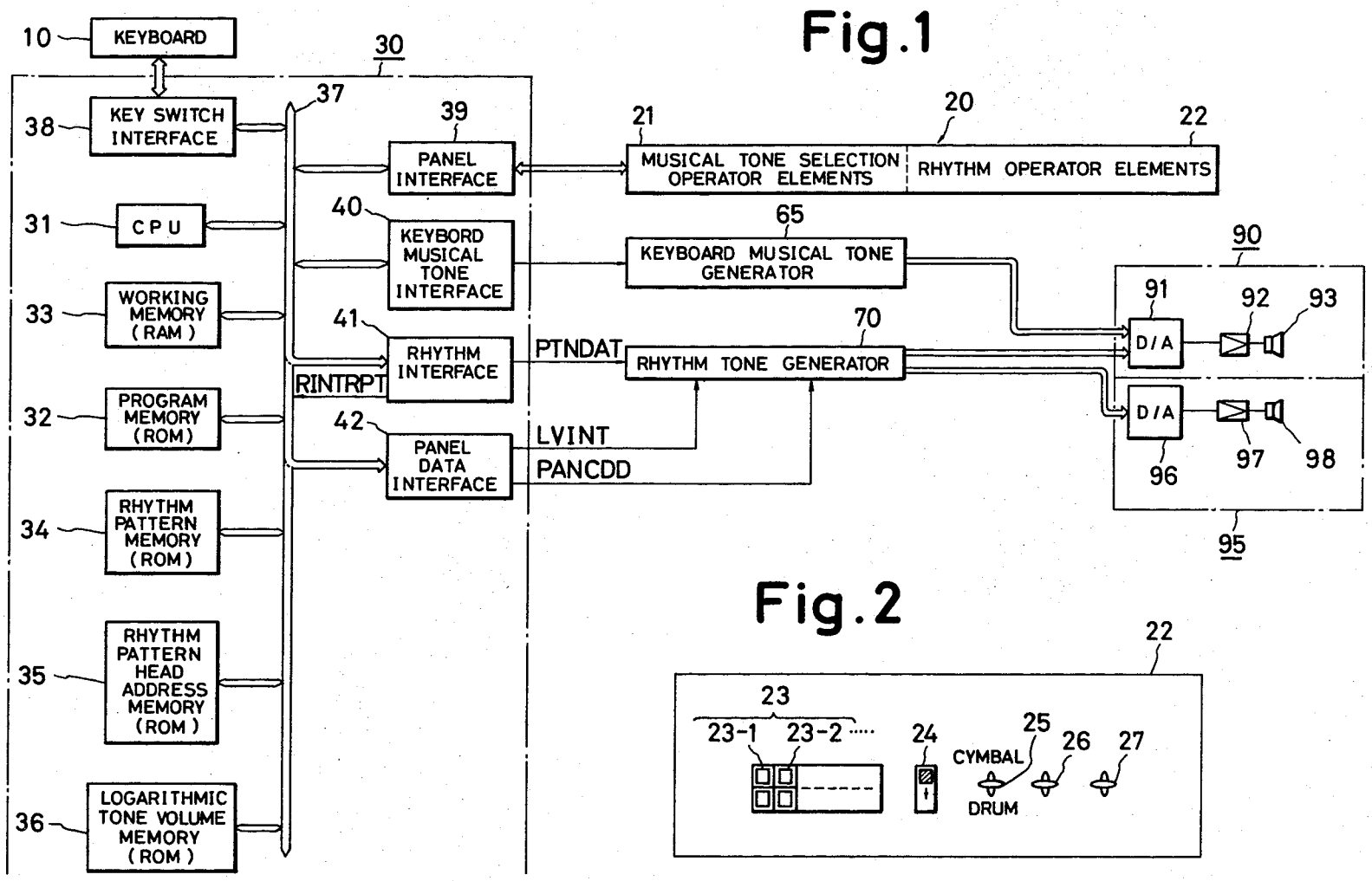
Fig.1
KEYBOARD
10
KEY SWITCH INTERFACE
38
CPU
31
WORKING MEMORY (RAM)
33
PROGRAM MEMORY (ROM)
32
RHYTHM PATTERN MEMORY (ROM)
34
RHYTHM PATTERN HEAD ADDRESS MEMORY (ROM)
35
LOGARITHMIC TONE VOLUME MEMORY (ROM)
36
30
37
PANEL INTERFACE
39
KEYBORD MUSICAL TONE INTERFACE
40
RHYTHM INTERFACE
41
RINTRPT
PANEL DATA INTERFACE
42
PTNDAT
LVINT
PANCDD
MUSICAL TONE SELECTION OPERATOR ELEMENTS
21
RHYTHM OPERATOR ELEMENTS
20
22
KEYBOARD MUSICAL TONE GENERATOR
65
RHYTHM TONE GENERATOR
70
D/A
91
92
93
90
D/A
96
97
98
95
Fig.2
22
23
23-1
23-2
24
CYMBAL
DRUM
25
26
27

41
DB
RHYDEC4
FUNCTION REG.
47
RHYDEC1
TEMPO REG.
6
44
TEMPO ROM
48
PSD
COUNTER
CK
LD
CO
49
50
RINTRPT
CLOCK GEN.
R
51
52
START
TRANS
CHANNEL REG.
3
46
RHYDEC3
COMP.
EQ
54
CHANNEL COUNTER
53
ChT
S
R
Q
56
55
CHEQ
RHYDEC2
RHYTHM TONE DATA REG.
7
45
SELECTOR
A
B
SB
57
S/R (8/7)
58
ChT
S/R(8/7)
59
KON
60
P/S CONV.
P9
P3
P2
P1
LD
"1"
ChT
61
PTNDAT
DECODER
43
RHYDEC1
RHYDEC2
RHYDEC3
RHYDEC4
ADB

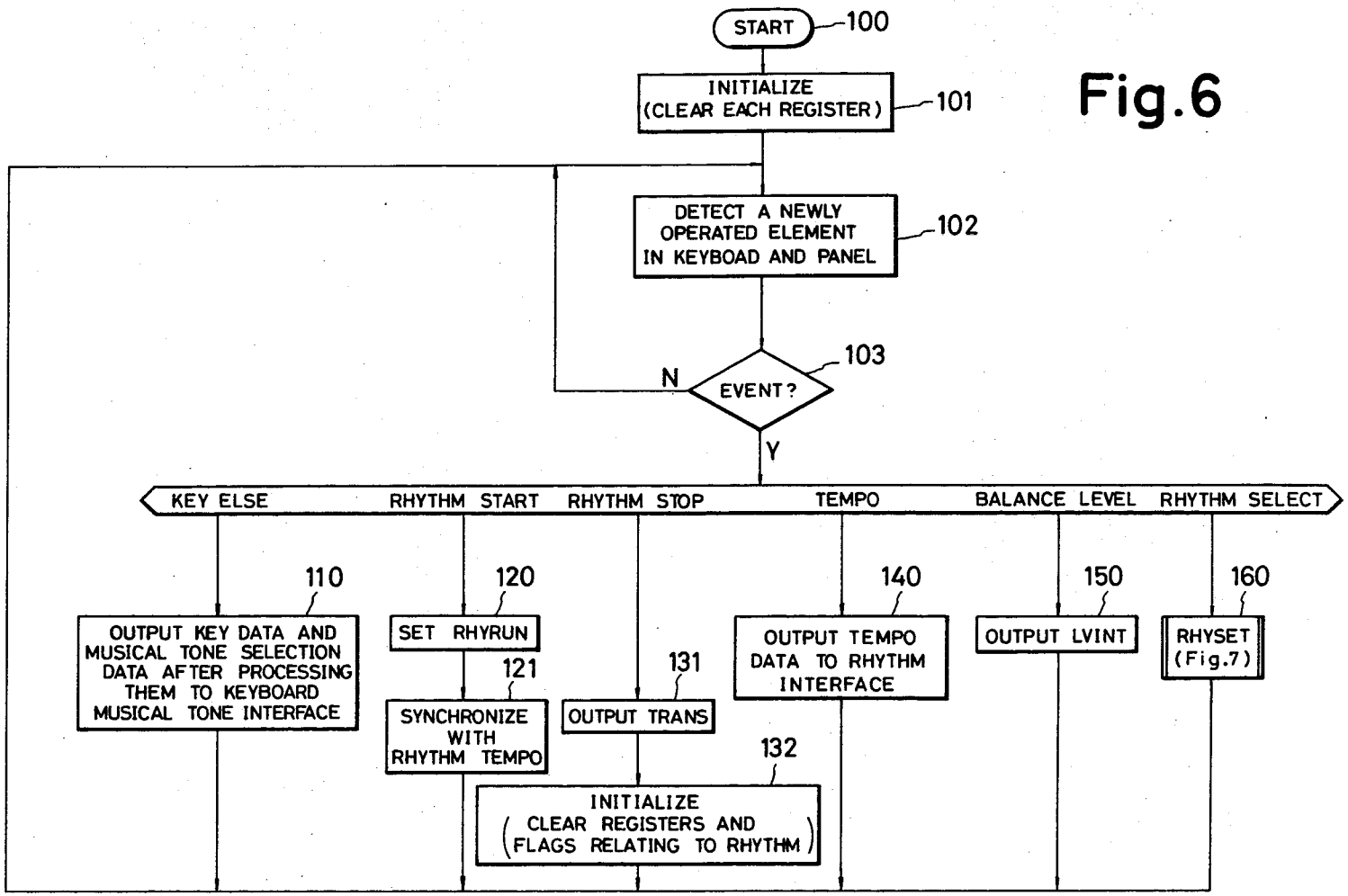
Fig.6
START
100
INITIALIZE (CLEAR EACH REGISTER)
101
DETECT A NEWLY OPERATED ELEMENT IN KEYBOAD AND PANEL
102
EVENT?
103
Y
N
KEY ELSE
RHYTHM START
RHYTHM STOP
TEMPO
BALANCE LEVEL
RHYTHM SELECT
OUTPUT KEY DATA AND MUSICAL TONE SELECTION DATA AFTER PROCESSING THEM TO KEYBOARD MUSICAL TONE INTERFACE
110
SET RHYRUN
120
SYNCHRONIZE WITH RHYTHM TEMPO
121
OUTPUT TRANS
131
INITIALIZE (CLEAR REGISTERS AND FLAGS RELATING TO RHYTHM)
132
OUTPUT TEMPO DATA TO RHYTHM INTERFACE
140
OUTPUT LVINT
150
RHYSET (Fig.7)
160

AUTOMATIC RHYTHM PERFORMANCE DEVICE

BACKGROUND OF THE INVENTION

1. Field of the Invention

The present invention relates to an automatic rhythm performance device capable of playing in a selected rhythm a plurality of sounds of percussive instruments through time-division multiplexing.

2. Description of the Prior Art

One known type of automatic rhythm performance device for playing in a selected rhythm a plurality of percussive instruments is disclosed in U.S. Pat. No. 4,336,736. In this prior device, percussive instrument tones are determined in advance which are assigned respectively to time-division multiplexing tone production channels for each of a variety of rhythm types. By selecting a certain rhythm, an allocated percussive sound can be produced on each of the tone production channels. However, the conventional arrangement requires an increased memory capacity for storing percussive instrument tones allocated respectively to tone production channels per each rhythm type.

SUMMARY OF THE INVENTION

There are many percussive instrument tones available for playing a variety of rhythm types, but percussive instrument tones used in reality for generating individual rhythms are relatively few. With this finding in view, an automatic rhythm performance device of the present invention resides in that a multiplicity of, for example 28, percussive instrument tones are prepared, and fewer, for example 8, percussive instrument tones enough for playing at least one rhythmic tone are selected from all of the prepared percussive instrument tones, thereby forming an instrument group. A plurality of, for example 8, such instrument groups are formed which correspond respectively to one or more rhythm types, and when a desired rhythm is selected and a corresponding instrument group is determined, the tones of the percussive instruments constituting the corresponding instrument group are assigned respectively to few, for example 8, time-division multiplexed tone production channels. According to the present invention, the tones of percussive instruments are assigned respectively to time-division multiplexed tone production channels, not for each of a variety of rhythm types as with the prior art, but for each of the above instrument groups, thereby reducing the memory capacity required for storing the percussive sounds.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 1 is a block diagram of an electronic musical instrument incorporating therein an automatic rhythm performance device according to an embodiment of the present invention;

FIG. 2 is a front elevational view of controllers in a rhythm section of a panel of the electronic musical instrument shown in FIG. 1;

FIGS. 6 through 10 are flowcharts showing operations of the electronic musical instrument illustrated in FIG. 1.

DESCRIPTION OF THE PREFERRED EMBODIMENT

Figure 3:
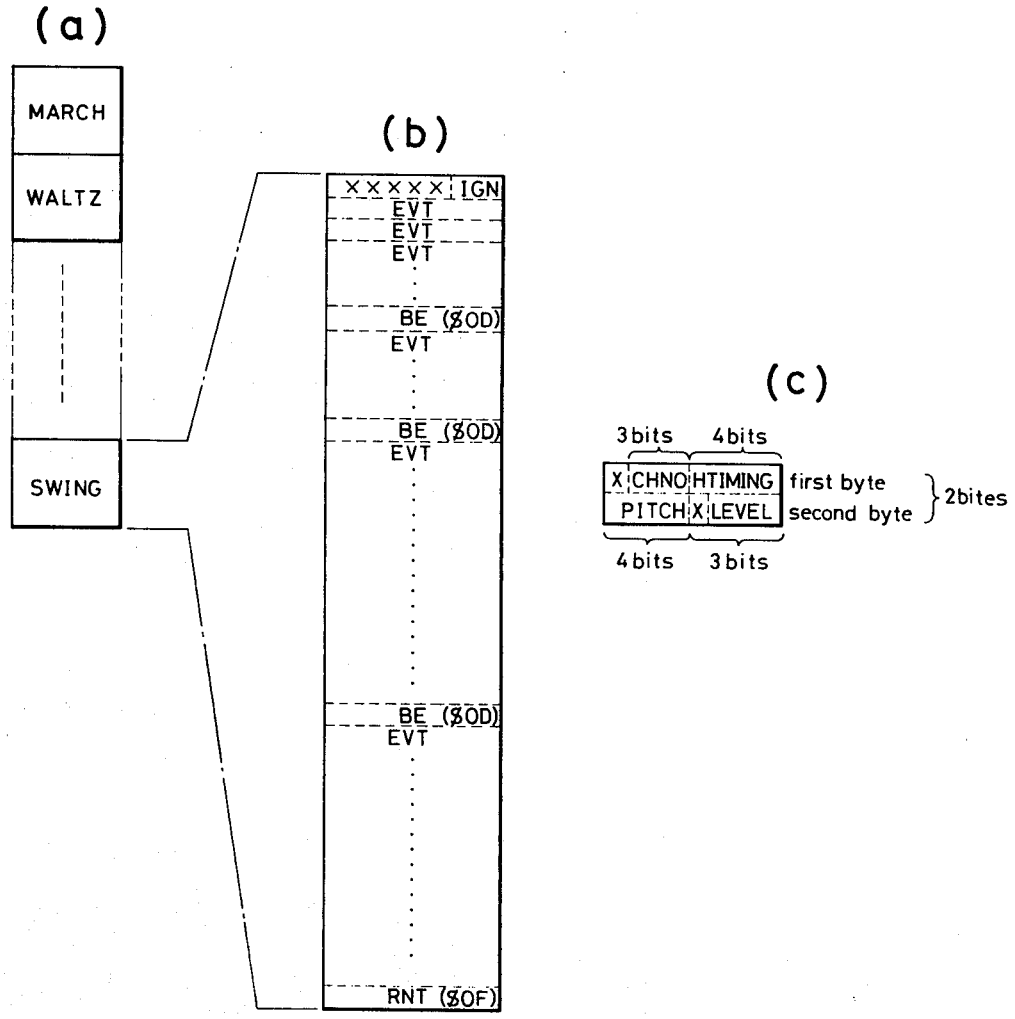
FIG. 3 is a diagram of data stored in a rhythm pattern memory in the electronic musical instrument shown in FIG. 1.

FIG. 1 shows in block form an electronic musical instrument in which an automatic rhythm performance device according to the present invention is incorporated. The electronic musical instrument includes a keyboard unit 10 composed of an upper keyboard (UK), a lower keyboard (LK) and a pedal keyboard (PK) (all now shown) for producing key information responsive to key operation by a player. A panel 20 has musical tone selection operator elements 21 and rhythm operator elements 22 for producing operator element information such as musical tone selection and rhythm pattern selection. A control unit 30 scans the keyboard unit 10 and the panel 20 for picking up the key information and operator element information generated and delivering out various data on keyboard musical tones and rhythm tones based on the the supplied information through a keyboard musical tone interface, a rhythm interface and the like. The electronic musical instrument also includes a keyboard muscial tone generator 65 supplied with the data on keyboard musical tones from the control unit 30 and produces keyboard musical tone data on each of time-division multiplexed channels (for example, the number of channels is 10), and generates time-division multiplexed keyboard tone signals corresponding to their keyboard musical tone data. A rhythm tone generator 70 is fed with the data on rhythm tones from the control unit 30 for generating eight tone signals corresponding to eight kinds of percussive instruments respectively on eight time-division multiplexed tone production channels and for delivering these percussive instrument tone signals to a central loudspeaker or a lefthand loudspeaker dependent on the percussive instrument and the rhythm pattern selected. The keyboard musical tone signals and the percussive instrument tone signals for the central loudspeaker are converted into audible tones by a central sound system 90 composed of a D/A converter 91, an amplifier 92 and a loudspeaker 93, and the percussive instrument tone signals for the lefthand loudspeaker are converted into audible tones by a lefthand sound system composed of D/A converter 96, an amplifier 97 and a loudspeaker 98.

The components of the electronic musical instrument of the foregoing construction will be described in greater detail.

RHYTHM OPERATOR ELEMENTS 20

FIG. 2 shows various rhythm operator elements 20 arranged on the panel 20. Rhythm selection switches 23 (23-1, 23-2, . . . ) serve to select rhythm patterns such as march, waltz, swing and others. A start/stop switch 24 controls starting and stopping of generation of rhythms. A balancer 25 serves to set a ratio of the tone volume of a drum system to the tone volume of a cymbal (noise) system. A total volume knob 26 serves to set the volume of a rhythm tone (a mixing ratio therof to a keyboard musical tone). A tempo setting knob 27 serves to set a tempo for an automatic rhythm.

These balancer 25, the total volume knob 26 and the tempo setting knob 27 may be composed of multiple digital switches or a combination of a variable resistor with a voltage applied thereacross and an A/D converter for converting an analog voltage on a sliding contact in the variable resistor into a corresponding digital value.

CONTROL UNIT 30

As illustrated in FIG. 1, the control unit 30 comprises a central processing unit (CPU) 31 having a program counter (PC), an A register (A), an X register (X), a Y register (Y) and others, a program memory 32, a working memory 33, a rhythm pattern memory 34, a rhythm pattern head address memory 35, a logarithmic tone volume memory 36, a bus line 37, a keyswitch interface 38, a panel interface 39, a keyboard musical tone interface 40, a rhythm interface 41, and a panel data interface 42.

The program memory 32 is composed of a read-only memory (ROM) which stores a control program for controlling the CPU 31.

The working memory 33 is composed of a random-access memory (RAM) having a working area for temporarily storing various data produced while the control program is executed by the CPU 31. As shown in the table 1, the working area comprises registers or flags. In the following description, the registers and their contents will be referred to under the same labels. For example, a beat number register and its stored content are both called "HKPE". In the table 1, a tempo data register TEMPO, a total volume register TOTLEV, and a rhythm type register RHYPTN respectively store operator information from the tempo setting knob 27, the total volume knob 26 and the rhythm selection switches 23, and a drum system volume ratio register RHDLEV and a cymbal (noise) system volume ratio register RHCLEV store operator information from the balancer 25.

TABLE 1

| Name | Label | Capacity (byte) |
|---|---|---|
| Automatic rhythm tempo data register | TEMPO | 1 |
| Total volume register | TOTLEV | 1 |
| Drum system volume ratio register | RHDLEV | 1 |
| Cymbal system volume ratio register | RHCLEV | 1 |
| Rhythm type register | RHYPTN | 1 |
| Beat number register | HKPE | 1 |
| Rhythm run flag | RHYRUN | 1 |
| Beat change flag | RDISPF | 1 |
| Tempo counter | TMPCNT | 1 |
| Bar division timing counter | TIMING | 1 |
| Max-timing register | TMPMAX | 1 |
| Beat end/return flag | RHHEND | 1 |
| Rhythm pattern head address register | RHYROM | 2 |
| Pattern pointer | RHPNT | 1 |

The rhythm pattern memory 34 is composed of ROM for storing rhythm patterns such as march, waltz, . . . swing as shown in FIG. 3(*a*). As illustrated in FIG. 3(*b*) at an enlarged scale, each of these rhythm patterns comprises an instrument group number data IGN stored at a head address, several event data EVT related to a rhythm tone to be generated in each beat, several beat end data BE composed of data OD expressed in a hexadecimal notation (hereinafter referred to as "$OD"), and return data (bar end data) RNT ($OF) stored at a final address. As shown in the table 2, each instrument group is comprised of eight instrument tones each assigned to one of the eight channels, and rhythm types are assigned to eight such instrument groups, respectively, the rhythm types being generated by the instrument musical tones belonging to each instrument group.

TABLE 2

| | | INSTRUMENT GROUP ASSIGNMENT | | | | | | | | | | | | | | | |
|---|---|---|---|---|---|---|---|---|---|---|---|---|---|---|---|---|---|
| ING RHYTHM TYPE | | 0 MARCH TANGO | | 1 WALTZ BAL-LADE | | 2 SWING | | 3 LATIN ROCK DISCO 16 BEAT | | 4 BOUNCE SLOW ROCK 8 BEAT | | 5 BOSSA NOVA | | 6 SAMBA | | 7 LATIN | |
| CH | 0 | TOP CYMBAL | W | TOP CYMBAL | W | TOP CYMBAL | W | TOP CYMBAL | W | TAMBOU-RINE | C | TAMBOU-RINE | W | TAMBOU-RINE | W | CLAVES | C |
| | 1 | HH | W | HH | W | HH | W | HH | W | HH | W | HH | W | HH | W | MARACAS | C |
| | 2 | SD BRUSH OUT | W | SD BRUSH OUT | W | SD BRUSH OUT | W | CONGA | W | SD RIM | C | CABACA | W | CABACA | W | TIM-BALES | W |
| | 3 | SD LIGHT | W | SD LIGHT | W | SD LIGHT | W | SD HEAVY | W | SD HEAVY | W | SD MEDIUM | W | SD MEDIUM | W | BONGO | C |
| | 4 | BD LIGHT | W | BD LIGHT | W | BD LIGHT | W | BD HEAVY | W | BD HEAVY | W | BD HEAVY | W | BD LIGHT | W | CONGA | W |
| | 5 | CASTA-NETS | W | SD BRUSH ROLL | C | CRUSH CYMBAL | W | CRUSH CYMBAL | W | CRUSH CYMBAL | W | TRI-ANGLE | C | AGOGO | C | GUIRO | C |
| | 6 | HH PEDAL | C | HH PEDAL | C | HH PEDAL | C | TAMTAM | W | TAMTAM | W | SD RIM | C | TAMTAM | W | COWBELL | C |
| | 7 | SD RIM | C | SD RIM | C | SD RIM | C | FLOOR TOM | W | FLOOR TOM | W | FLOOR TOM | W | FLOOR TOM | W | FLOOR TOM | W |

CC. . .Central loudspeaker,
W. . .Lefthand loudspeaker,
HH. . .High hat,
SD. . .Snare drum,
BD. . .Bass drum The electronic musical instrument shown in FIG. 1 is constructed to generate a rhythm at timings (called "beat division timing") each being 1/12 of one beat. The event data is stored in the rhythm pattern memory 34 in the order of such beat division timings. As shown in FIG. 3(*c*), the event data EVT is composed of two bytes in an 8-bit memory and includes a beat division timing HTIMING produced by an event and taking less significant four bits (4th to 1st bits) of a first byte, a channel number CHNO in 7th to 5th bits for forming tone data, a pitch PITCH in more significant four bits (8th to 5th bits) of a second byte for a percussive instrument tone generated in the beat division timing, and a level LEVEL in 3rd to 1st bits for the scale level of a percussive instrument tone, that is, data indicative of whether the level of a percussive instrument tone generated at the timing is ff or pp, the 4th bit of the second byte being a blank bit. The beat end data BE serves as a boundary between adjacent beats, and the return data RNT represents the final end of a rhythm pattern or the bar end where the rhythm is of a single-bar pattern. The beat end data BE and the return data RNT are indicative of no event or no generation of a rhythm tone in a beat subsequent to the beat division timing indicated by immediately preceding event data EVT.

In FIG. 1, the rhythm pattern head address memory 35 comprises a conversion ROM for storing the head addresses of various rhythm patterns stored in the rhythm pattern memory 34 and outputting a rhythm pattern head address in response to a content PHYPTN fed from the rhythm type register.

The logarithmic tone volume memory 36 comprises a conversion ROM for logarithmic conversion of the total tone volume TOTLEV, the drum system tone volume ratio RHDLEV and the cymbal system tone volume ratio RHCLEV. After having performed the logarithmic conversion, these volume and volume ratios are computed and delivered as an 8-bit cymbal tone volume CLEV and an 8-bit drum system tone volume DLEV to the rhythm tone generator 70 through the panel data interface 42. The cymbal system tone volume CLEV is obtained as the product of the total tone volume TOTLEV and the cymbal system tone volume ratio RHCLEV, and can be easily and speedily computed as the sum of the logarithmic values of the total tone volume TOTLEV and the cymbal system tone volume ratio RHCLEV as a result of the logarithmic conversion carried out in the logarithmic tone volume memory 36.

The bus line 37 is composed of a data bus (DB) and an address bus (ADB) which interconnect the CPU 31, the memories 32 through 36, and the interfaces 38 through 42 for data transmission and receipt therebetween.

The rhythm interface 41 serves to temporarily store rhythm tone data delivered from the CPU 31, to convert stored data into serial data PTNDAT under a command from the CPU 31 and transmit the serial data to the rhythm tone generator 70, and to produce an interrupt signal RINTRPT for enabling the CPU 31 to transfer data on an interrupt basis when supplied with a rhythm start signal from the CPU 31 and on each one beat thereafter.

Figure 4:
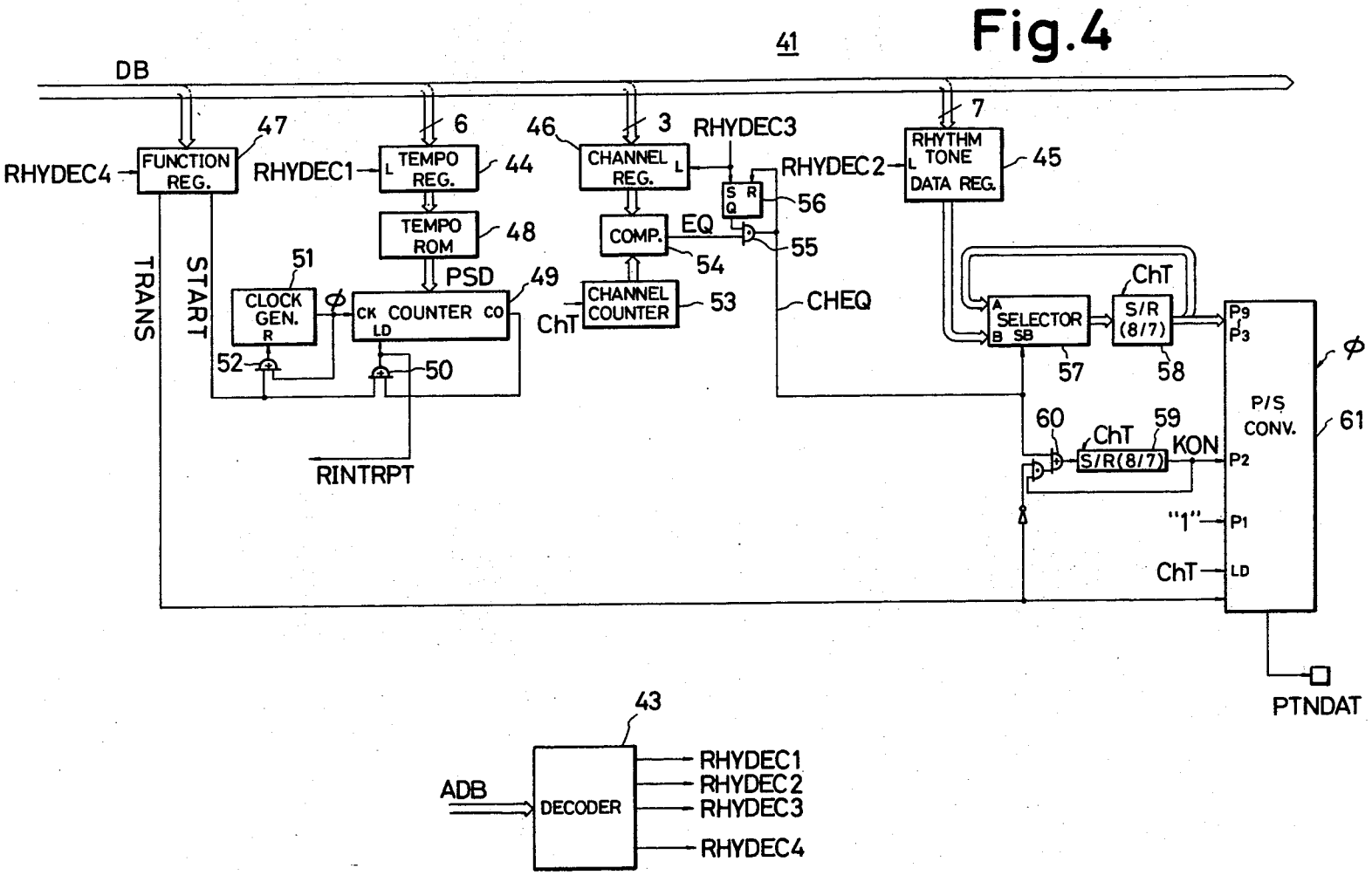
FIG. 4 is a detailed block diagram of a rhythm interface in the electronic musical instrument shown in FIG. 1.

FIG. 4 shows in detailed block form the rhythm interface 41. A decoder 43 serves to deliver load signals RHYDEC 1 through 4 respectively to a tempo register 44, a rhythm tone data register 45, a channel register 46 and a function register 47 when an address signal delivered from the CPU 31 (FIG. 1) over the address bus ADB designates either one of these registers 44 through 47. Thus, the data sent from the CPU 31 over the data bus DB is stored in the register which is specified by the address signal simultaneously delivered from the CPU 31 over the address bus ADB.

The tempo register 44 stores new tempo data TEMPO each time the content of the tempo data register TEMPO is changed. A tempo ROM 48 serves to convert the tempo data TEMPO outputted from the tempo register 44 into preset data PSD in a counter 49. When a signal at a load terminal LD, or an output from an OR circuit 50 is of a logic level "1", the preset data PSD is preset in the counter 49. Then, the counter 49 counts a clock signal $\phi$ of a fixed frequency from a clock generator 51, and produces an output of "1" at an output terminal Co at the time of an overflow. The output from the counter 49 is applied to one input terminal of the OR circuit 50 so that the counter 49 is preset on each overflow. More specifically, the counter 49 produces an output having a tempo set by the tempo setting knob 27 (FIG. 2) by dividing the frequency of the clock signal $\phi$ at the ratio of $1/(N-M)$ where N is an overflow value and M is a preset value. The counter 49 may be of the type capable of counting down the clock signal $\phi$ after having been preset to produce an output of "1" to the output terminal Co, thus frequency-dividing the clock signal $\phi$ at the ratio of $1/M$. Alternatively, other known variable-frequency counters may be employed. The other input terminal of the OR circuit 50 is connected to a start output terminal of the function register 47, so that the counter 49 can be preset also when the function register 47 produces a start signal START (described later on). The output from the OR circuit 50 is also delivered as the interrupt signal RINTRPT to the CPU 31, which starts an interrupt operation (described later on) at the same time that the counter 49 is preset. The output from the clock generator 51 is applied to one input terminal of an OR circuit 52 which has an output terminal connected to a reset terminal of the clock generator 51. Accordingly, the clock generator 51 is reset immediately when it produces an output. The other input terminal of the OR circuit 52 is fed with the start signal START. When the start signal START is generated, the counter 49 is preset and at the same time the clock generator 51 is reset.

The 7bit data composed of the 3-bit level LEVEL and the 4-bit pitch PITCH in the event data EVT as read from the rhythm pattern memory 34 by the CPU 31 (FIG. 1) is stored in the rhythm tone data register 45, and the channel number CHNO in the event data EVT is temporarily stored in the channel register 46. A channel counter 53 serves to count a channel timing signal ChT repetitively from 0 to 7, the channel timing signal ChT being generated by frequency-dividing a clock P at a frequency-division ratio capable of transmitting parallel data entering a P/S converter 61 as serial data. A comparator 54 compares an output from the channel counter 53 with the channel number CHNO from the channel register 46, and delivers out a channel coincidence signal CHEQ through an AND circuit 55 when the output from the channel counter 53 coincides with the channel number CHNO. A flip-flop 56 is set by a load signal PRHYDEC 3 from the channel register 46 and reset by the channel coincidence signal CHEQ. The channel coincidence signal CHEQ is outputted from the AND circuit 55 as the logical product of the output from the comparator 54 and a set output Q from the flip-flop 56. After the channel number CHNO has been loaded, only one channel coincidence signal is outputted which has a differentiated waveform of a leading edge of the channel timing signal ChT. The channel coincidence signal CHEQ is applied as an input to an SB terminal of a selector 57. Only when the channel coincidence signal CHEQ is produced, the level data LEVEL and the pitch data PITCH stored in the rhythm tone data register 45 are loated in an 8-stage/7-bit shift register 58. The channel coincidence signal CHEQ is also stored as a key-on signal KON through an OR circuit 60 into an 8-stage/1-bit shift register 59. Since the shift registers 58, 59 and the channel counter 53 is operated by the same channel timing signal ChT, the data stored in the rhythm tone data register 45 are loaded in a channel corresponding to the channel number CHNO in the channel register 46 in synchronism with the channel timing in the shift registers 58, 59.

The function register 47 takes in data delivered over the data bus DB from the CPU 31 when an output RHYDEC 4 from the decoder 43 is of a logic level "1" on address designated by the CPU 31. When the data thus supplied is $01, the function register 47 delivers out the start signal START in the form of a pulse of short width and thereafter is automatically cleared. When the data is $20, the function register 47 outputs a time transfer signal TRANS in order to enable the P/S converter 61 to deliver all 8-channel data serially for the shift registers 58, 59, and then is automatically cleared.

The P/S converter 61 is successively supplied at its parallel data input terminals P2 through P9 with rhythm data stored for 8 channels in the shift registers 58, 59 in synchronism with the channel timing signal ChT, which is applied to a load terminal of the P/S converter 61. When the transfer signal TRANS signal is produced by the function register 47, the P/S converter 61 takes in data at the terminals P1 through P9 for a single channel in response to the channel timing signal ChT applied, converts the data into serial data PTNDAT, and then supplies the serial data PTNDAT to the rhythm tone generator 70 in synchronism with the clock signal $\phi$. The foregoing cycle is repeated eight times to deliver out data for all eight channels.

The terminal P1 is supplied at all times with a marker or input confirmation signal of "1". When data is transferred, continuous input data "0" is changed into "1" at least at P1. Therefore, if data at P2 through P9 are all "0", the rhythm tone generator 70 can determine, with the first "1" data at P1, that the "0" data following the first "1" data at the P1 are effective data transferred from the rhythm interface 41.

PANEL DATA INTERFACE 42

As shown in FIG. 1, the panel data interface 42 effects logarithmic conversion on the total tone volume TOTLEV, the drum system tone volume RHDLEV and the cymbal system tone volume RHCLEV read by the CPU 31 from the total volume knob 26 and the balancer 25. The panel data interface 42 also carries out an arithmetic operation on the supplied data to provide the 8-bit cymbal system tone volume CLEV and the drum system tone volume DLEV, which are converted into 16-bit serial data LVINT that is sent to the rhythm tone generator 70. At the same time, the panel data interface 42 converts the instrument group number data IGN read from the rhythm pattern memory 34 into serial data PANCDD which is then delivered to the rhythm tone generator 70.

RHYTHM TONE GENERATOR 70

Figure 5:
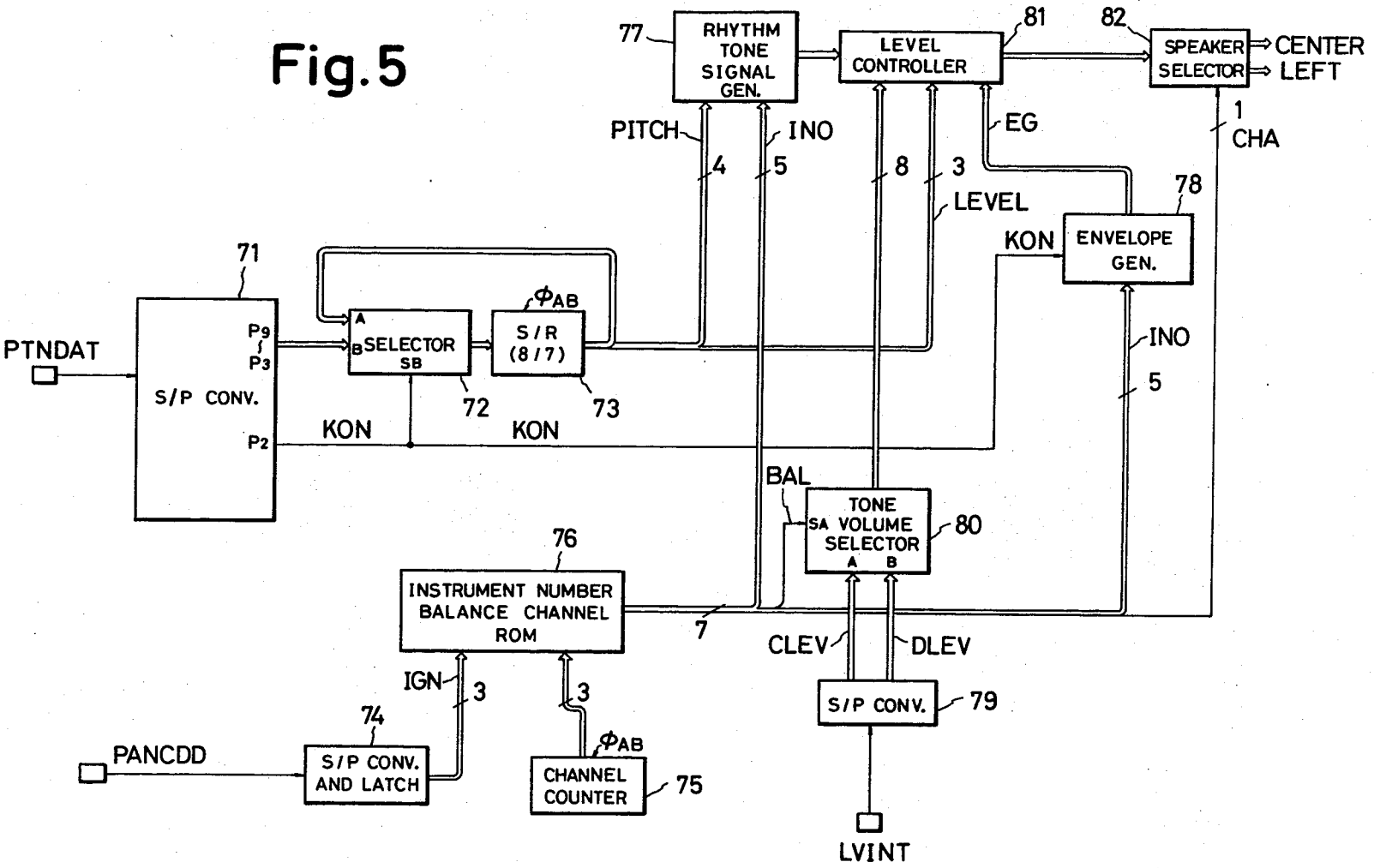
FIG. 5 is a detailed block diagram of a rhythm tone production circuit in the electronic musical instrument shown in FIG. 1.

FIG. 5 is a block diagram showing in detail the rhythm tone generator 70. The rhythm tone generator 70 comprises an S/P converter 71, a selector 72, an 8-stage/7-bit shift register 73, an S/P converter and latch circuit 74, a channel counter 75, an instrument number balance channel ROM 76, a rhythm tone signal generator 77, an envelope generator 78, an S/P converter circuit 79, a tone volume selector 80, a level controller 81, and a speaker selector 82. The rhythm tone generator 70 serves to receive the data PTNDAT, LVINT, PANCDD relating to rhythms and issued serially from the rhythm interface 41 and the panel data interface 42 in the control unit 30 (FIG. 1) for generating a percussive instrument tone signal in each of eight time-division multiplexed channels.

The rhythm tone generator 70 is driven as a whole by a clock signal $\phi_{AB}$ produced by frequency-dividing the clock signal $\phi$ by at least a computation time slot number for one channel in the rhythm tone generator 77. The eight rhythm tone generation channels are formed on a time-division multiplexed basis respectivley in time slots successively divided in each period of the clock signal $\phi_{AB}$. Eight percussive instruments constituting each instrument group are assigned respectively to these eight channels.

The S/P converter 71 converts the serial data PTNDAT transferred from the rhythm interface 41 (FIG. 1) into parallel data, and also temporarily stores 8-channel parallel data and issues the latter to output terminals P9 through P2 for each channel in synchronism with the channel counter 75.

A select terminal SB of the selector 72 is normally of a logic level of "0", and the selector 72 outputs a signal which is applied to its input terminal A. Once supplied with the signal, the shift register 73 thus stores the supplied signal while successively shifting and circulating the same each time the clock $\phi_{AB}$ is applied. When the key-on signal KON is applied to the output terminal P2 of the S/P converter 71 to supply "1" to the select terminal SB of the selector 72, the shift register 73 is supplied with rhythm tone data issued from the output terminal P9 through P3 of the S/P converter 71. In order to bring the data-delivering rhythm interface 41 (FIG. 1) into conformity with the channel, the transfer signal TRANS is generated by the function register 47 (FIG. 4), for example, in synchronism with the channel 0 in the channel counter 53 to transfer data successively from the channel 0 to the channel 7, and the data-receiving rhythm tone generator 70 outputs the output from the S/P converter 71 successively from the channel number 0 outputted by the channel counter 75 in synchronism with the output from the channel counter 75 or the system clock $\phi$AB.

The S/P converter and latch circuit 74 serves to convert the 8-bit serial data PANCDD including the instrument group number data IGN transferred from the panel data interface 42 (FIG. 1) into parallel data, and at the same time latches the parallel data until next serial data PANCDD is entered.

The channel counter 75 counts the system clock signal $\phi$AB and outputs the channel numbers CHNO from 0 to 7.

The instrument number balance channel ROM 76 is in the form of a conversion ROM for producing the instrument group number IGN and the channel control signal representing a 5-bit instrument number INO, that is, an instrument name, a 1-bit tone group signal BAL indicative of whether the instrument belongs to a cymbal family or a drum family, and a 1-bit tone generation control signal CHA indicative of whether the loudspeaker for producing the instrument tone is a central loudspeaker or a lefthand loudspeaker.

The rhythm tone signal generator 77 generates a percussive instrument tone waveform based on the 5-bit instrument number INO outputted from teh instrument number balance channel ROM 76 and the 4-bit pitch data PITCH outputted from the shift register 73. The rhythm tone signal generator 77 may be a known waveform memory type or a computation type. Where the waveform memory type signal generator is used, start and end addresses of the memory are specified by the instrument number INO and the pitch data PITCH. Where the computation type signal generator is employed, a constant for determining a pitch and a timbre is set up by the instrument number INO, and the pitch data PITCH utilized for slightly correcting the pitch.

The envelope generator 78 is responsive to the key-on signal KON generated at the output terminal P2 of the S/P converter 71 for starting envelop data EG representing a form determined by the instrument number INO issued from the instrument number balance channel ROM 76.

The S/P converter 79 converts serial data LVINT composed of the cymbal sytem tone volume CLEV and the drum system tone volume DLEV outputted from the panel data interface 42 into parallel data and also temporality stores the converted parallel data.

The tone volume selector 80 serves to select the cymbal system tone volume CLEV or the drum system tone volume DLEV according to the tone group signal BAL generated by the instrument number balance channel ROM 76 and delivers out the selected tone volume to the level controller 81.

The level cotnroller 81 is composed of a multiplier, for example, for effecting an arithmetic operation on the tone waveform data from the rhythm tone signal generator 77, the cymbal system tone volume CLEV or the drum system tone volume DLEV from the tone volume selector 80, the level data LEVEL from the shift register 73, and the envelope data EG from the envelope generator 78 to produce time-division multiplexed percussive instrument tone signals.

The speaker selector 82, responses to a tone production channel signal generated by the instrument number balance channel ROM 76, directs the percussive instrument tone signals produced by the level controller 81 to the central and lefthand channel sound systems 90, 95 (FIG. 1).

OPERATION OF THE ELECTRONIC MUSICAL INSTRUMENT OF FIG. 1

Operation of the electronic musical instrument illustrated in FIG. 1 will be described with reference to the flowcharts of FIGS. 6 through 9, with particular emphasis on the control unit 30. In FIG. 6, when a power supply for the electronic musical instrument is turned on, the CPU 31 starts in a step 100 to operate under the control program stored in the program memory 32. At a step 101, the CPU 31, the registers and flags in the working memory 33, the rhythm interface 41 and the others are cleared thereby initializing the overall circuit arrangement. The keyboard 10 and the control elements on the panel 20 are scanned in a step 102 to detect any change in the element positions and element information. For instance, when the information from each control element is different from the previous element information stored in the registers TEMPO, TOTLEV, RHDLEV, RHCLEV, RHYPTN and the like, the current control element information can be detected as having been changed, that is, as the occurrence of an event. In the step 102, the control element information can be detected when the rhythm start/stop switch 24 is shifted to the start or stop side. The control element information may be expressed, for example, by digital data of 0 through 15 indicative of the settings by the total volume knob 26 and the balancer 25. The digital data is then stored in the total tone volume register TOTLEV, the drum system tone volume ratio register RHDLEV and the cymbal system tone volume ratio register RHCLEV.

A step 103 serves to determine whether an event has been detected or not in the step 102. If there is no event detected, then the program goes back to the step 102 for detecting any event. If there is an event, then the program proceeds to effect data processing in subsequent steps dependent on the kind of an event detected.

When the event as detected in the step 102 is a tone change effected by a key depression or release or by a depression of the musical tone selection operator elements 21, the program goes on to a step 110. In the step 110, the key data or the musical tone selection data is processed and outputted to the keyboard musical tone interface 40. The keyboard musical tone interface 40 delivers the supplied data to the keyboard musical tone generator 65.

When the event is a start command issued by the start/stop switch 24, a rhythm run flag RHYRUN is set in the working memory 33 in a step 120, and thereafter a rhythm tempo is synchronized in a step 121. This is performed by loading data $01 in the function register 47 (FIG. 4) in the rhythm interface 41 to enable the function register 47 to produce a start signal START, which is employed to reset the counter 49 and the clock generator 51. Upon generation of the start signal START, the rhythm interface 41 interrupts the operation of the CPU 31, which then follows an interrupt process RHIRQ (described later on) following a step 200 shown in FIG. 8 to deliver serial data PTNDAT, LVINT, PANCDD and others related to rhythm tones to the rhythm tone generator 70 via the rhythm interface 41 and the panel data interface 42.

When the event as detected in the step 102 represents a rhythm stop entered by the start/stop switch 24 (FIG. 2), a data transfer command TRANS is delivered in a step 131. This is carried out by loading data $20 into the function register 47 (FIG. 4) in the rhythm interface 41 to thereby allow rhythm tone data PTNDAT to be transferred to the rhythm tone generator 70. In a step 132, the rhythm-related registers and flags such as the rhythm run flag RHYRUN, the beat change flag RDISPF, and others as set forth in the table 1 are cleared.

When the event in the step 102 is a tempo change entered by the tempo setting knob 27, tempo data TEMPO is loaded into the tempo register 44 (FIG. 4) in the rhythm interface 41 in a step 140. The tempo data thus stored in the tempo register 44 determines a tempo with which a beat division timing, that is, a rhythm pattern is to be read out.

When the event as detected in the step 102 is a change of setting by the total volume knob 26 or the balancer 25, the control element settings TOTLEV, RHDLEV, RHCLEV are converted into corresponding logarithmic values with reference to the logarithmic tone volume memory 36, and the logarithmic values are then added (equivalent to multiplication of tone volumes) to find a cymbal system tone volume CLEV and a drum system tone volaume DLEV, which are then covnerted into serial data LVINT. The serial data LVINT is thereafter supplied to the rhythm tone generator 70.

Figure 7:
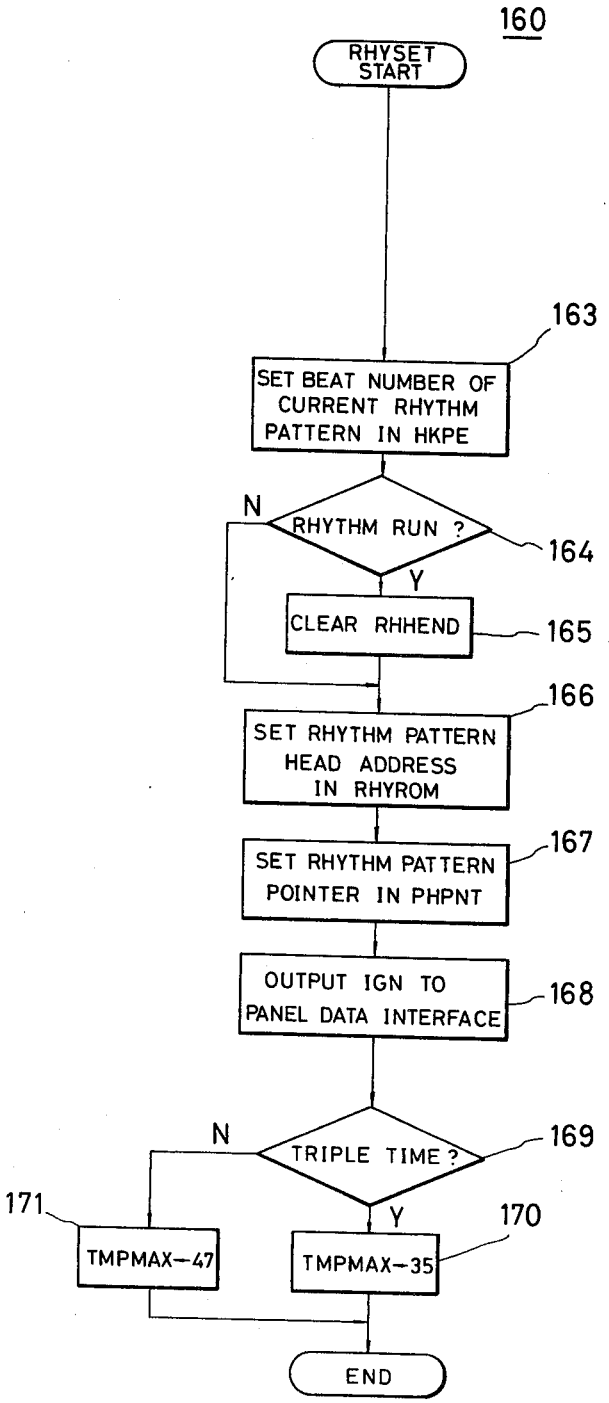

When the event in the step 102 is to vary a rhythm type RHYPTN through depression of the rhythm selection switches 23, a rhythm setting process RHYSET 160 as shown in FIG. 7 is executed. More specifically, the beat number in the beat number register HKPE is set to 1 if the timing TIMING ranges from 0 to 11, to 2 if the timing TIMING ranges from 12 to 23, to 3 if the timing TIMING ranges from 24 to 35, and to 4 if the timing TIMING ranges from 36 to 47 with reference to the content of the bar division timing counter TIMING. This is to allow a rhythm to be continued at the same timing as that prior to the rhythm type change, and is employed in a step 167 to set a pattern pointer PHPNT in an address in which rhythm pattern data having the same beat number and same beat division timing is stored. In a step 164, a rhythm run flag RHYRUN is checked. If the rhythm is in progress, then a beat end flag RHHEND is cleared in a step 165. The beat end flag RHHEND needs to be cleared because if it remained set, the reading of event data would be skipped (see a step 401) which a changed rhythm would have after the rhythm change timing. If no event data is present subsequently to the rhythm change, then the beat end flag RHHEND is set when setting the rhythm pointer RHPNT. If the rhythm is determined as being stopped in the step 164, then the program skips the step 165 and goes on to a step 166 since the beat end flag RHHEND has already been cleared in the step 132 during the rhythm stop process.

In the step 166, the rhythm pattern head address memory 35 is addressed by the content RHYPTN of the rhythm type register to read out the head address for a rhythm type selected and store the head address in the head address register RHYRO. In a step 167, the rhythm pattern memory 34 is designated by an address indicated by the sum of the head address RHYROM and the pattern pointer RHPNT to successively read out data from the head address. The number of beat end data BE as read out and the beat division timing HTIMING, and the beat number HKPE and the timing TIMING are compared to set the pattern pointer RHPNT. The instrument group number IGN stored in the head address RHYROM in the rhythm pattern memory 34 is read out and outputted to the panel data interface 42 in a step 168. The panel data interface 42 then converts the instrument group number IGN into serial data PANCDD, which is delivered to the rhythm tone generator 70.

A step 169 serves to determine whether the rhythm type RHYPTN is a triple time or a quadruple time. If the rhythm type is a triple time, then a maximum timing number 35 in one bar is stored in a maximum timing register TMPMAX in a step 170. If the rhythm type is a quadruple time, then a maximum timing number 47 in one bar is stored in the maximum timing register TMPMAX in a step 171.

Upon completion of the processing in the steps 110 through 171 for an event after it has been detected in the step 102, the program goes back to the step 102 for detecting another event.

With the electronic musical instrument illustrated in FIG. 1, as described above, when the start/stop switch 27 is switched to a start position, the rhythm interface 41 delivers an interrup signal RINTPT to the CPU 31 at the rate of 1/12 of one beat, that is, at a beat division timing according to a set tempo. Therefore, the CPU 31 executes an interrupt process INTRPT 200 shown in FIG. 8 at the time of rhythm starting and at the subsequent beat division timing.

In a step 201, the registers, the program counter and others are saved so as to allow return to the original condition after the interrupt process has ended. Then, a rhythm tone production data output process RHIRQ 210 illustrated in FIG. 9 is executed.

Figure 8:
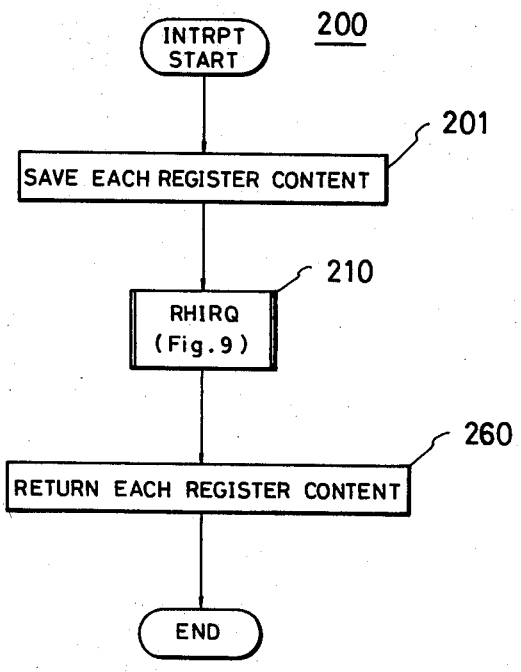
Figure 9:
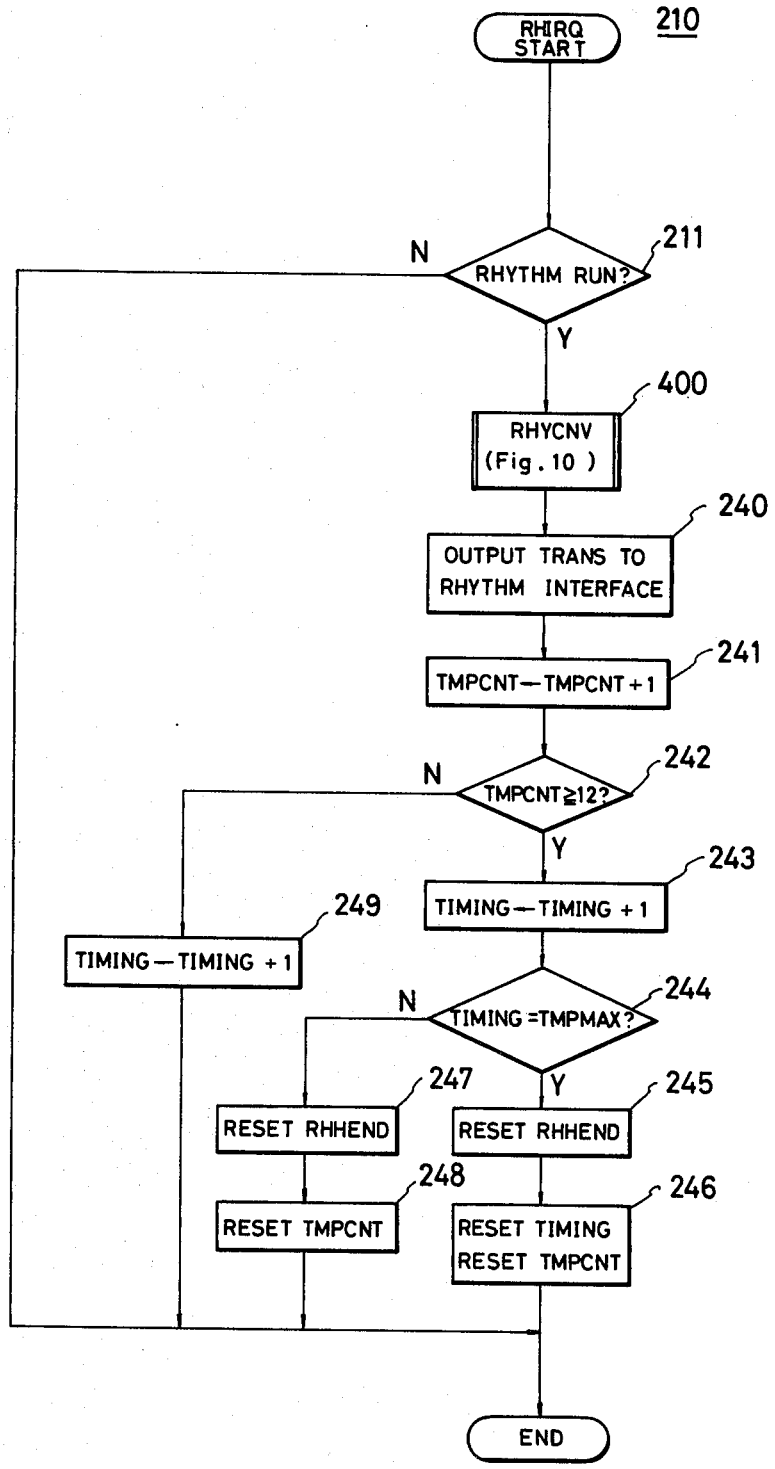

In FIG. 9, the rhythm run flag RHYRUN is checked in a step 211 to ascertain whether the rhythm is in progress. If the rhythm is stopped, then it is not necessary to output rhythm tone data, and hence the process RHIRQ 210 is brought to an end. The interrupt process is immediately stopped in a step 260 (FIG. 8), and the program goes back to the routine shown in FIGS. 6 or 7. If the rhythm is in progress in the step 211, then the program proceeds to a rhythm data output subroutine RHYCNV 400 (FIG. 10).

Figure 10:
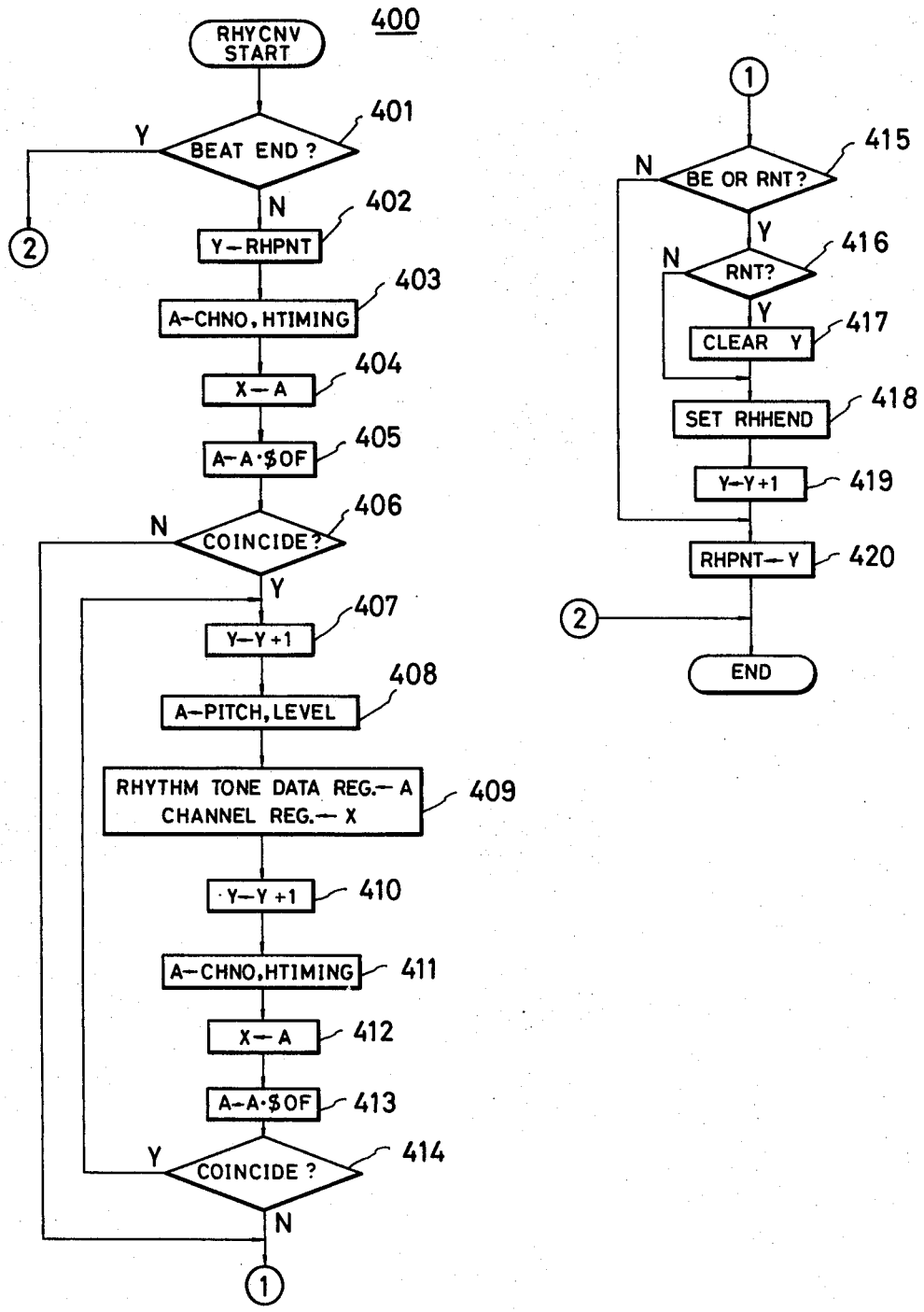

As shown in FIG. 10, a beat end flag RHHEND is checked in a step 401 to determine whether the beat is ended or not. If the beat is ended, then the program goes back to the previous routine (FIG. 9) as there is no event data in the timing TMPCNT until the beat is over. If the beat is not ended, then the content of the rhythm pointer RHPNT is set in the Y register in a step 402, and then the rhythm pattern memory 34 is addressed by the sum of the read pattern head address RHYROM and the content of the Y register (that is, the content RHPNT of the rhythm pointer) in steps 403, 404 to read and store the channel data CHNO in the first byte in FIG. 3(*c*) and the beat division timing data HTIMING in the A register and the X register. Next, AND operation of the content of A register and $OF is performed and only a portion of the content of the A register is left which corresponds to the beat division timing data expressed by the less significant four bits, in a step 405. A step 406 determines whether this beat division timing data coincides with the timing indicated by the tempo counter TMPCNT. If these timings coincide in the step 406, then the data is effective as the timing TMPCNT to be processed presently, and the content of the Y register is stepped up or incremented in a step 407. In a step 407, the pitch PITCH and level LEVEL data in the second byte are read from the event data EVT shown in FIG. 3(*c*) and stored in the A register. In a step 409, the pitch and level data stored in the A register are supplied to the rhythm tone data register 45 (FIG. 4), and the channel number CHNO stored in the X register is supplied to the channel register 46 (FIG. 4).

In a step 410, the content of the Y register acting as the rhythm pointer is further stepped up in order to read out next event data EVT. In steps 411 through 414, the procedure in the steps 403 through 406 is repeated, and all event data EVT having the same beat division timing as that of the current timing TMPCNT are read out in the steps 407 through 414. If there is no event data with the same beat division timing in the step 406 or 414, the program goes on to a step 415, which determines whether the timing data left in the A register in the step 405 or 413 exceeds $OD or not. Since the beat division timing is always in the range of from $O to $B, the content A of the register A becomes greater than $OD only when reading out the beat end data BE or the return data RNT. If the A register≧$OD, then a step 416 determines whether the A register=$OF or not. If the A register=$OF, that is, return data, then the Y register is cleared in a step 417. If the A register ≠$OF, that is, beat end data, the program goes to a step 418 while skipping the step 417. In the step 418, the beat end flag RHHEND is set. The content of the Y register is stepped up in a step 419, and the content of the Y register is set in the rhythm pointer RHPNT in a step 420. The program then returns to the previous routine (the step 240 in FIG. 9). When the return data RNT is detected by the processing in the steps 417, 419 and 420, the rhythm pointer PHPNT is set to 1. When the beat end data BE is detected, the rhythm pointer RHPNT is indicative of an address next to the address in which the beat end data BE is stored in the step 4319. When the beat division timing is not beat end/return in the step 415, the program proceeds to the step 420, and the address at the time of reading out the beat division timing with which the rhythm opinter PHPNT does not coincide with the timing TMPCNT is stored as it is. Then, the program goes back to the step 240 in the routine illustrated in FIG. 9.

As shown in FIG. 9, a data transfer command is issued to the rhythm interface in the step 240 by specifying an address in the function register 47 (FIG. 4) and loading $20 therein. The function register 46 then outputs a transfer signal TRANS which is applied to the P/S converter 40. The pitch and level data supplied to the rhythm interface 41 and stored in the shift register 58 for each channel, and the key-on data KON stored in the shift register 59 are converted by the P/S converter 61 into 9-bit serial data PTNDAT, which is delivered to the rhythm tone generator 70 (FIG. 1), in the step 409.

In a step 241, the tempo counter TMPCNT is incremented. A step 242 determines whether the beat is over or not based on the tempo counter content TMPCNT. Since there are 12 (0 through 11) timings in one beat, the beat is over when the timing TMPCNT indicated by the tempo counter overflows. If the step 242 determines that the beat is over, then the timing counter TIMING is incremented in a step 243. Since the beat is over when the bar is over, it is possible for the bar to be over each time the beat is over. Therefore, a step 244 ascertains whether the beat-over in the step 242 results in the bar-over by finding whether the content TIMING of the timing counter has reached the maximum tempo number TMPMAX. When the bar is over, the beat end flag RHHEND is reset in a step 245, the timing counter TIMING and the tempo counter TMPCNT are reset in a step 246, and thereafter the program returns to a step 260 of FIG. 8. When the beat is over but the bar is not over, the beat end flag RHHEND is rest in a step 247, the tempo counter TMPCNT is reset in a step 248, and thereafter the program goes back to the step 260 in FIG. 8.

If the beat is found not over in the step 242, the timing counter TIMING is incremented in a step 249, and then the program goes back to the step 260 (FIG. 8) from a step 250.

With reference to FIG. 8, the program returns through the steps 211, 246, 248, 249 and 250 in the rhythm tone production data output process RHIRQ (FIG. 9), and thereafter the program counter and the registers put out of operation for the interrupt process INTRPT are returned in a step 260. The process shown in FIGS. 6 and 7 prior to the interrupt process is then resumed.

With the arrangement of the present invention, instrument groups composed of as many instruments as there are rhythm tone production channels are established, and a suitable instrument groups are selected respectively for rhythm types, so that rhythm tones of any rhythm types can be produced by employing the instrument tones in all of the rhythm tone production channels. The automatic rhythm performance device of the present invention is capable of producing more rhythm tones than prior automatic thythm performance devices having as many rhythm tone production channels.

Although a certain preferred embodiment has been shown and described, it should be understood that many changes and modifications may be made therein without departing from the scope of the appended claims.

What is claimed is:

1. An automatic rhythm performance device having a plurality of time-division multiplexed tone production channels, comprising:

rhythm selecting means for selecting a rhythm type of rhythm to be performed from among a plurality of thythm types;

rhythm pattern storing means for storing rhythm patterns representing the timings relating to rhythm tone production per each of said plurality of rhythm types and for outputting the rhythm patterns of said selected rhythm type, said rhythm patterns being assigned to said tone production channels, respectively;

group number storing means for storing group numbers identifying groups, respectively, said plurality of rhythm types being allocated to one of said groups and for outputting the group number to which said selected rhythm type belongs;

instrument assigning means connected to said group number storing means for assigning instrument name information representing names of instruments to be performed to said tone production channels, respectively, said instrument name inforamtion being determined by said outputted group number; and rhythm tone generating means connected to said rhythm pattern storing means and said instrument assigning means for generating rhythm tone signals corresponding to said assigned instrument name information on the corresponding tone production channels at the timing relating to the corresponding rhythm patterns, respectively.

2. An automatic rhythm performance device according to claim 1, wherein said rhythm pattern storing means further stores channel numbers per each of said rhythm patterns, said channel numbers representing channels to which said rhythm patterns are assigned respectively, so that the assignment of said rhythm patterns to said tone production channels is performed in accordance with said channel numbers.

3. An automatic rhythm performance device according to claim 1, wherein said instrument assigning means comprises:

channel designating means for designating a current channel among said time-division multiplexed tone production channels; and instrument name storing means for storing said instrument name information to be assigned to said tone production channels per each of said group number and for assigning the corresponding one of said instrument name information corresponding to said outputted group number to the corresponding one of said tone production channels in response to said designated current channel.

4. An automatic rhythm performance device according to claim 3, wherein said channel designating means comprises:

counter means for counting clock pulses having a constant frequency as modulo M, M being the integer corresponding to that of said tone production channels.

5. An automatic rhythm performance device according to claim 1, wherein said rhythm patterns include level information and which further comprises:

level control means connected to said rhythm tone generating means for controlling the amplitude level of said rhythm tone signal in accordance with said level information.

6. An automatic rhythm performance device according to claim 1, wherein said rhythm patterns include level information and said rhythm tone signals have pitches corresponding to said pitch information.

7. An automatic rhythm performance device according to claim 1, which further comprises:

level setting means for setting drum level and cymbal level; and level control means connected to said rhythm tone generating means for controlling the amplitude level of the rhythm tones relating to drum in accordance with said set drum level and for controlling the amplitude level of the rhythm tones relating to cymbal in accordance with said set cymbal level.

* * * * *